United States Patent [19]

Hart et al.

[11] Patent Number: 4,613,016

[45] Date of Patent: Sep. 23, 1986

[54] SINGLE-CYLINDER TRUCK-MOUNTED BRAKE ASSEMBLY

[75] Inventors: James E. Hart, Trafford; William K. Mong, North Huntingdon; Allen W. Kyllonen, Plum Boro; Mark S. Krampitz, Hunker, all of Pa.

[73] Assignee: American Standard Inc., Wilmerding, Pa.

[21] Appl. No.: 764,047

[22] Filed: Aug. 9, 1985

[51] Int. Cl.[4] ..... B61H 13/24

[52] U.S. Cl. ..... 188/52; 188/202

[58] Field of Search ..... 188/52, 53, 54, 55, 188/153 R, 202, 203

[56] References Cited

U.S. PATENT DOCUMENTS

| | | | |
|---|---|---|---|
| 2,958,397 | 11/1960 | Newell | 188/33 |
| 3,017,959 | 1/1962 | Baechtel | 188/52 |
| 3,266,601 | 8/1966 | Taylor | 188/52 |
| 3,378,108 | 4/1968 | McClure | 188/52 |
| 3,406,791 | 10/1968 | Williams | 188/52 |
| 3,731,766 | 5/1973 | Campbell | 188/52 |
| 4,312,428 | 1/1982 | Beacon | 188/52 |

*Primary Examiner*—Duane A. Reger

*Attorney, Agent, or Firm*—G. J. Falce

[57] ABSTRACT

A single-cylinder, truck-mounted brake assembly for a railway car truck in which low-cost, light-weight, truss-type brake beams are employed, with one beam having an expansible brake actuator in the form of an air bag mounted thereon. The brake rigging arrangement employs an equalizing lever that is pivotally-connected to each brake beam at its centrally-located strut bar, and force-transmitting members between the respective ends of the equalizing levers, so that the force of the brake actuator is transferred from the brake beam strut bar to the brake shoes via the beam tension member. Accordingly, the light-weight, low-cost brake beams are not subjected to such bending forces as would otherwise require a stronger beam. The single-cylinder air bag arrangement is made possible by utilizing a slack adjuster device as the one force-transmitting member.

13 Claims, 2 Drawing Figures

SINGLE-CYLINDER TRUCK-MOUNTED BRAKE ASSEMBLY

BACKGROUND OF THE INVENTION

The present invention is concerned with truck-mounted brake rigging and, more particularly, to a single-cylinder truck-mounted brake rigging arrangement employing truss-type brake beams.

Present day brake rigging for railway car trucks employ a pair of parallel, spaced-apart brake beams; each arranged to carry a brake cylinder device having a piston and a piston rod that is operatively-connected to the other brake beam, so that the respective brake beams are moved in opposite directions by the fluid pressure force acting in opposite directions on the bodies of the brake cylinder devices and the respective pistons thereof. Such a brake rigging is shown in U.S. Pat. No. 2,958,398, issued Nov. 1, 1960 to George K. Newell.

Specially designed brake beams are necessary in this type of brake rigging in order to support the weight of the brake cylinder mounted thereon, and to support the bending forces exerted on the beams during braking.

In order to alleviate the higher cost of these special brake beams, arrangements have been proposed which employ but a single, beam-mounted brake cylinder device, so that the expense of one special brake beam and associated cylinder is saved. These single cylinder arrangements, however, generally require a slack adjuster device when employed in actual service conditions, since all of the accumulated slack resulting from wear of the brake shoes at all four wheels is reflected in the piston travel of the single brake cylinder. The addition of a slack adjuster tends to offset any savings that would otherwise be realized by replacement of a single, special brake beam with a conventional truss-type brake beam.

SUMMARY OF THE INVENTION

It is, therefore, the object of the present invention to provide a low-cost, truck-mounted brake rigging arrangement that employs a single brake actuator device per truck and a pair of brake beams, both being of conventional, truss-type design.

Another object of the invention is to provide a truck-mounted brake rigging in accordance with the foregoing objective wherein the single brake actuator device is mounted on a truss-type brake beam.

Another object of the invention is to provide a truck-mounted brake rigging in accordance with the foregoing objectives, arranged such that the braking forces transmitted to the truss-type brake beams act at the midpoint thereof.

Yet another object of the invention is to provide a truck-mounted brake rigging in accordance with the foregoing objectives, arranged such that an expansible air bag may be employed as the single brake actuator device.

Still another object of the invention is to arrange the single-actuator, truck-mounted brake rigging so as to lie in a substantially horizontal plane at a height above the track rails, which permits passage of the rigging members through the openings normally available in a standard style bolster.

The brake rigging arrangement, according to the present invention, consists of two truss-type brake beams disposed on opposite sides of the truck bolster with one beam having an expansible air bag mounted on the beam compression member adjacent a strut bar that interconnects the tension and compression members of the beam at the beam midpoint. Pivotally-connected to each beam strut bar is an equalizing lever, the corresponding ends of which are interconnected by force-transmitting members that pass through horizontally-spaced openings in the bolster. One force-transmitting member includes the expansible air bag, while the other force-transmitting member comprises a slack adjuster device that locks-up in response to both the.triggering means and compressive forces as the air bag expands and contracts to apply and release the brakes.

BRIEF DESCRIPTION OF THE DRAWINGS

These and other objects and attendant advantages of the invention will become more apparent from the following more detailed explanation when taken in conjunction with the drawings in which.

DESCRIPTION AND OPERATION

Figure 1:
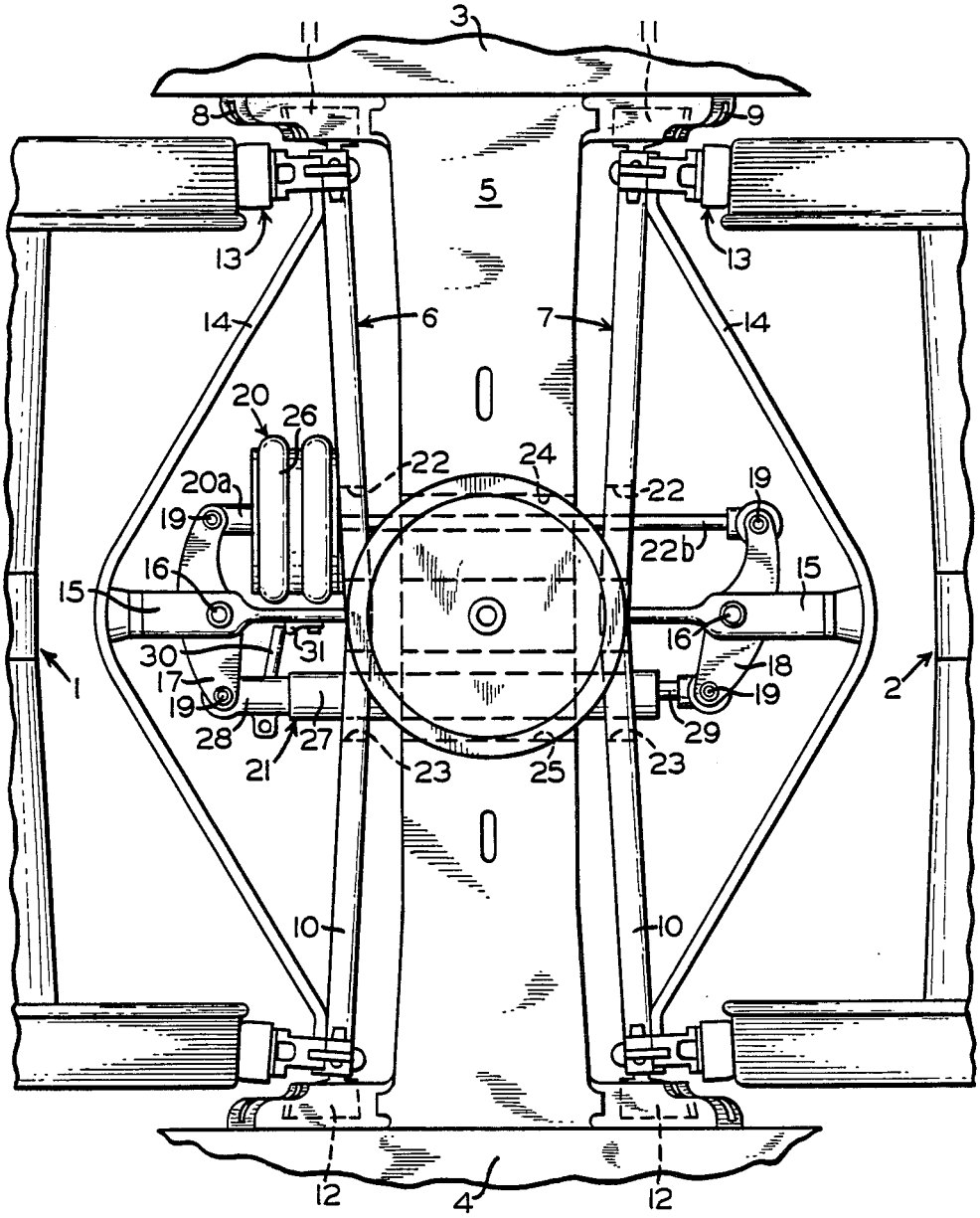
FIG. 1 is an assembly plan view of a railway car truck showing the truck-mounted brake rigging arranged in accordance with the present invention.

Referring to FIG. 1 of the drawings, a railway car truck is shown comprising a pair of wheel/axle units 1 and 2, a pair of side frames 3 and 4 supported on the wheel/axle units by journal bearings in a conventional, well-known manner, and a bolster 5 that is spring-supported at its ends on the respective side frames. A pair of parallel brake beams 6 and 7 are spaced-apart on opposite sides of bolster 5, and extend laterally between the side frames, with their ends being supported in guide pockets 8 and 9 formed in the truck side frames.

Brake beams 6 and 7 are identical in construction, each including a compression member 10 that extends laterally between the side frames with guide feet 11 and 12 fixed in a suitable manner to the ends of compression member 10, so as to ride in pockets 8 and 9 and thereby guidably-support the brake beams at the proper height above the rails and somewhat below the axis of a wheel-/axle unit. Also fixed to the brake beam near the ends of compression member 10 adjacent the wheel treads (in a well-known, conventional manner) is a brake head and brake shoe assembly 13. Guide pockets 8 and 9 are formed in the truck side frames at a slight angle with the horizontal, so that the motion of the brake beam during a brake application brings the brake shoes radially into engagement with the wheel treads.

Also fixed to each end of the brake beam compression member is a laterally-extending tension member 14, the center of which is rigidly-connected to the midpoint of compression member 10 by a strut bar 15. As is well-known in the railway braking art, truss-stype brake beams, such as, brake beams 6 and 7, are capable of supporting relatively high bending forces by reason of the stress in tension member 14 increasing as compression member 10 tends to bend. Consequently, brake beams 6 and 7, while being made of relatively light-weight construction, are sufficiently strong to withstand the force of braking transmitted to brake head and brake shoe assembly 13 via the brake beams.

Figure 2:
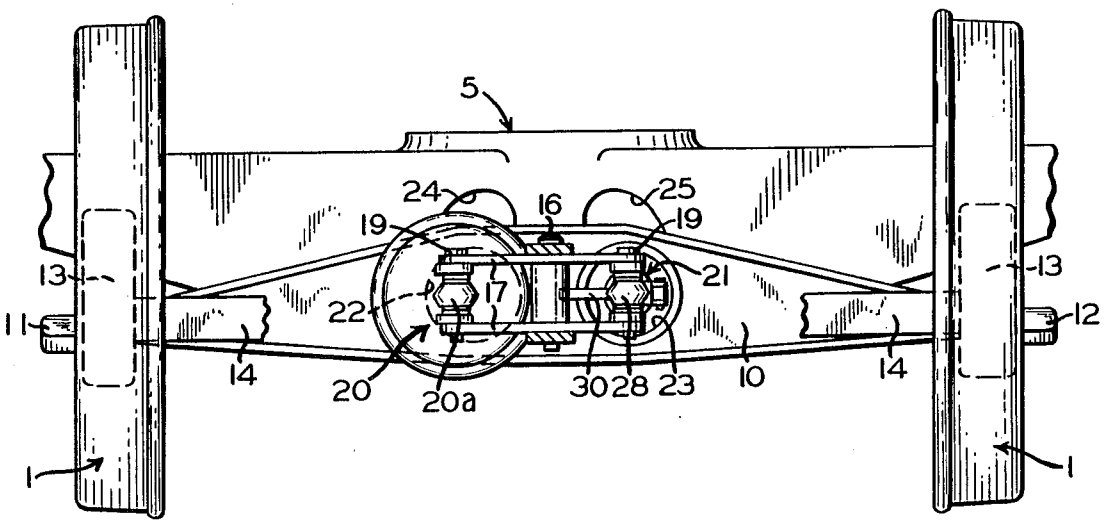
FIG. 2 is a left-side elevation view with the brake beam tension member broken away to show the air bag actuator and equalizing lever connections with the force-transmitting members, as well as to show the rigging disposition with respect to the openings that are provided in the brake beam compression member and in the bolster to accommodate the rigging.

Pivotally-connected by a pin 16 within the jaws of bifurcated strut bar 15 of the respective brake beams 6 and 7 are identical, bifurcated, equalizing levers 17 and 18, as shown in FIGS. 2 and 3. Connected by pins 19 to corresponding ends of the respective equalizing levers 17 and 18, so as to lie in a substantially horizontal plane, are force-transmitting members 20 and 21 which pass through openings 22 and 23 provided in the compression member 10 of each brake beam and through standard openings 24 and 25 in bolster 5. An actuator device, such as, an expansible air bag 26, is suitably-mounted to one brake beam 6 by being bolted or otherwise secured to compression member 10, at a location between the compression and tension members and in alignment with opening 22 in compression member 10 of beam 6. Air bag 26 is interposed in force-transmitting member 20, such that one portion 20*a* of member 20 connects the free end of air bag 26 to equalizing lever 17, while the other portion 20*b* of member 20 connects the fixed end of air bag 26 to equalizing lever 18. As an alternative to the air bag 26, the actuator device may be a conventional piston-type cylinder, employing either packing cup, diaphragm, or metal ring piston sealing means. Also, portion 20*b* of member 20 could alternatively be bolted or otherwise secured directly to compression member 10 of brake beam 6.

In accordance with the foregoing, it will be appreciated that all the aforementioned parts of the brake rigging lie in the horizontal plane in which the force-transmitting members 20 and 21 lie, and that this horizontal plane rises and falls as brake applications are made and released, due to the angle of inclination of guide pockets 8 and 9 in which guide feet 11 and 12 operate.

The respective arms of equalizing levers 17 and 18 may be equal in length or, as shown in the present arrangement, of unequal length in order to align force-transmitting member 20 and the centerline of air bag 26 so as to be offset from the centerline of opening 22 in the compression member of brake beams 6 and 7. It will be appreciated that in making the one arm of equalizing levers 17 and 18 longer than the other arm, it is possible to use a larger diameter air bag 26 without the wall of the air bag interfering with strut bar 15. An attendant advantage is realized by the mechanical advantage gained through the lever ratio resulting from the disproportionate lever arm lengths.

Force-transmitting member 21 is in the form of a double-acting slack adjuster device 27, such as the slack adjuster device disclosed in copending U.S. application, Ser. No. 714,596, filed 3-21-85, assigned to the assignee of the present invention. One end 28 of the slack adjuster housing is connected to equalizing lever 17, while the opposite end 29 associated with an extendable rod of the slack adjuster, that is axially-movable relative to the slack adjuster housing, is connected to equalizing lever 18.

A trigger arm 30 is pivotally-connected to the slack adjuster housing at its outboard side and passes laterally through openings (not shown) in the slack adjuster housing into proximal engagement with a lug 31 on strut bar 15 of brake beam 6. The trigger arm thus rotates with relative movement between the brake beam 6 and force-transmitting member 21, as a means of detecting excessive expansion of air bag 26 due to brake shoe/wheel wear.

The brake rigging, according to the present arrangement, operates in response to the supply and release of compressed air with respect to air bag 26. Having its fixed end secured to the left-hand side of the compression member of brake beam 6, air bag 26 responds to the supply of compressed air thereto by an axial expansion of its free end relative to its fixed end. Being connected to equalizing lever 17 by portion 20*a* of force-transmitting member 20, the free end of air bag 26 effects rotation of equalizing lever 18 about pivot pin 16 in a counterclockwise direction, as the air bag expands axially with the supply of compressed air thereto. This counterclockwise rotation of equalizing lever 17 results in force-transmitting member 21 being moved in the direction of the right-hand to, in turn, effect counterclockwise rotation of equalizing lever 18 about its pivot pin 16. In that portion 20*b* of force-transmitting member 20 is secured to the fixed end of air bag 26, resistance to movement is encountered at the end of equalizing lever 18 connected to force-transmitting member 20 by pin 19, so that lever 18 acts as a second-class lever. Thus, the force exerted at the other end of equalizing lever 18 from force-transmitting member 21 causes equalizing lever 18 to pivot about its connection with force-transmitting member 20 and thereby move brake beam 7 in the direction of the right-hand through the connection of equalizing lever 18 with strut bar 15, thereby bringing the brake shoes of brake head and brake shoe assemblies 13 associated with brake beam 7 into engagement with the wheel treads of wheel/axle unit 2.

Once brake shoe engagement occurs at brake beam 7, the connection of equalizing lever 17 with force-transmitting member 21 at pin 19 becomes solid and equalizing lever 17 also becomes a second-class lever. Thus, continued expansion of the free end of air bag 26 causes the counterclockwise rotation of equalizing lever 17 to take place by pivotal rotation about the pin connection 19 of equalizing lever 17 with force-transmitting member 21. Accordingly, the force of expansion of air bag 26 acts through pin 16 of equalizing lever 17 and strut bar 15 to force brake beam 6 in the direction of the left-hand, thereby bringing the brake shoes of brake head and brake shoe assemblies 13 associated with brake beam 6 into engagement with the wheel treads of wheel/axle unit 1.

In that slack adjuster device 27 has been previously disclosed in copending application, Ser. No. 714,596, it should suffice to say here that during a brake application, (according to the foregoing explanation) slack adjuster device 27 is capable of supporting the compressive forces exerted on force-transmitting member 21, of which slack adjuster 27 is an integral part by means of trigger arm 30 engaging lug 31 to lock up the slack adjuster. It should also be noted that in the event brake shoe wear occurs during the aforementioned brake application engagement of trigger arm 30 of the slack adjuster device 27 with lug 31 on the strut bar 15 will initiate the adjuster action in an amount corresponding to the degree of brake shoe wear. Completion of the brake application rotates the trigger arm in a counterclockwise direction about its pivotal connection with the slack adjuster housing to the lock-up position, enabling the compressive braking forces to be developed.

When the brake application is released, the compressed air effective in air bag 26 is exhausted, allowing the respective brake beams to be moved by the force of gravity, down the inclined guide pockets 8 and 9, toward a retracted position in which the brake shoes of the respective brake head and brake shoe assemblies are maintained a predetermined distance apart from the associated wheel tread braking surface. During the initial release movement, slack adjuster device 27 reacts to the actuated trigger arm 30, indicative of the brake shoe wear that occurred while the brakes were being applied during the previous brake application and to extend the slack adjuster until the trigger arm 30 is pivoted out of engagement with lug 31. When this occurs, sufficient slack will have been taken up to compensate for the brake shoe wear and the slack adjuster will now lock-up, so as to support the force exerted through the rigging as the brake beams continue to be retracted with the exhaust of brake pressure from air bag 26. This retraction of the brake beams to move the brake shoes out of engagement with the wheel treads results in movement of the equalizing levers 17 and 18, and force-transmitting members 20 and 21, as well as brake beams 6 and 7, in a manner opposite to that occurring during application of the brakes.

It will be appreciated that by affixing the one side of air bag 26 to brake beam 6 at compression member 10 and having the slack adjuster trigger arm 30 sense lug 31 on the brake beam strut bar, the relationship between the trigger arm and the shoe-wear reference point provided by lug 31 remains constant for any given position of the brake beams, thereby assuring an accurate reading of brake shoe wear and consequent slack take-up by the slack adjuster operation.

In addition, the rigging arrangement accommodates a light-weight, low-cost air bag to provide the desired actuating forces. Furthermore, the use of light-weight, low-cost, truss-type brake beams, which require that the braking forces be applied at the midpoint of the brake beams, is made possible by the rigging configuration. These considerations, coupled with the fact that only a single-actuator device is employed, result in a novel, efficient and economical brake apparatus.

Having now described the invention, what we claim as new and desire to secure by Letters Patent, is:

1. A brake rigging for a railway car truck having a pair of wheel/axle units comprising:

(a) substantially parallel, spaced-apart brake beams interposed between said pair of wheel/axle units and having brake shoes carried thereon adjacent the respective wheel treads of said wheel/axle units for engagement therewith when said brake beams are moved apart;

(b) first and second equalizing levers, each being pivotally-connected at a point intermediate the ends thereof to one of said brake beams at the midpoint thereof;

(c) first force-transmitting means connected between corresponding arms of said first and second equalizing levers including a force actuator for effecting rotation of one of said first and second equalizing levers; and (d) second force-transmitting means connected between the other arms of said first and second equalizing levers for effecting rotation of the other of said equalizing levers in response to said rotation of said one equalizing lever, whereby a force is exerted on said brake beams at said pivotal connection of said first and second equalizing levers therewith to urge movement of said brake beams in opposite directions and accordingly urge said brake shoes into engagement with the wheel treads of said wheel/axle units.

2. A brake rigging, as recited in claim 1, wherein said second force-transmitting means includes slack adjuster means actuable for varying the distance between said other arms of said first and second equalizing levers.

3. A brake rigging, as recited in claim 2, wherein one of said brake beams includes a reference lug and said slack adjuster means comprises:

(a) a housing; and (b) a trigger arm pivotally-connected to said housing at one end and axially-aligned with said reference lug at the opposite end, said trigger arm being engageable with said reference lug to effect said actuation of said slack adjuster means when brake shoe wear occurs.

4. A brake rigging, as recited in claim 1, wherein said force actuator is an expansible air bag, the opposite ends of which expand axially in response to fluid pressurization thereof.

5. A brake rigging, as recited in claim 4, wherein one end of said air bag is fixed to one of said brake beams, while the other end of said air bag is connected to said corresponding arm of one of said first and second equalizing levers to effect said rotation thereof.

6. A brake rigging, as recited in claim 5, wherein said first force-transmitting means comprises:

(a) said air bag;

(b) a first rod portion connected between said other end of said air bag and said corresponding arm of said one equalizing lever; and (c) a second rod portion connected between said one end of said air bag and said corresponding end of the other of said first and second equalizing levers.

7. A brake rigging, as recited in claim 6, further characterized in that the length of said first and second rod portions is fixed.

8. A brake rigging, as recited in claim 1, further characterized in that said brake beams are truss-type brake beams.

9. A brake rigging, as recited in claim 8, wherein said truss-type brake beams each comprise:

(a) a substantially longitudinal compression member;

(b) a tension member connected to said compression member at the extremities thereof and spaced-apart from said compression member at the midpoint thereof; and (c) a strut bar arranged transversely of said compression member between the midpoint thereof and said tension member on which a respective one of said first and second equalizing levers is pivotally-connected.

10. A brake rigging, as recited in claim 9, wherein said compression member of each said beam has formed therein first and second openings on opposite sides of the midpoint thereof through which said first and second force-transmitting means pass.

11. A brake rigging, as recited in claim 10, wherein said force-transmitting means comprises:

(a) an air bag, the opposite ends of which expand axially in response to fluid pressurization thereof, one end of said air bag being fixed to said compression member at said first opening therethrough;

(b) a first rod portion connected between said other end of said air bag and said corresponding arm of said one equalizing lever; and (c) a second rod portion carried in said first opening of each said compression member and connected between said one end of said air bag and said corresponding end of the other of said first and second equalizing levers.

12. A brake rigging, as recited in claim 11, wherein said second force-transmitting means includes slack adjuster means operative for varying the distance between said other arms of said first and second equalizing levers.

13. A brake rigging, as recited in claim 12, wherein one of said brake beams includes a reference lug formed on said strut bar thereof, said slack adjuster means comprises:

(a) a housing; and (b) a trigger arm pivotally-connected to said housing at one end and axially-aligned with said reference lug at the opposite end, said trigger arm being engageable with said reference lug to effect said actuation of said slack adjuster means when brake shoe wear occurs.

* * * * *